US006773388B2

(12) United States Patent
Rathbun

(10) Patent No.: US 6,773,388 B2
(45) Date of Patent: Aug. 10, 2004

(54) FOLDER APPARATUS WITH TRANSVERSE LOADING

(75) Inventor: Darryl T. Rathbun, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/186,497

(22) Filed: Jun. 28, 2002

(65) Prior Publication Data

US 2004/0005980 A1 Jan. 8, 2004

(51) Int. Cl.[7] ..... B31F 1/10

(52) U.S. Cl. ..... 493/434; 493/405; 493/409; 493/416; 493/421; 493/442; 493/454

(58) Field of Search ..... 493/434, 395, 493/402, 405, 409, 416, 421, 442, 454

(56) References Cited

U.S. PATENT DOCUMENTS

| | | | | | |
|---|---|---|---|---|---|
| 3,897,943 | A | * | 8/1975 | Head et al. | 493/434 |
| 4,340,212 | A | | 7/1982 | Simson | |
| 4,421,501 | A | | 12/1983 | Scheffer | |
| 4,493,690 | A | | 1/1985 | Niemiro et al. | 493/444 |
| 4,504,259 | A | * | 3/1985 | Lindenmuller | 493/23 |
| 4,643,705 | A | | 2/1987 | Bober | 493/444 |
| 5,076,556 | A | | 12/1991 | Mandel | 270/45 |
| 5,080,340 | A | | 1/1992 | Hacknauer et al. | 270/37 |
| 5,222,934 | A | | 6/1993 | Ochsner | 493/444 |
| 5,364,332 | A | | 11/1994 | Gray, Jr. | 493/23 |
| 5,520,603 | A | | 5/1996 | Bluthardt et al. | 493/421 |
| 6,024,682 | A | | 2/2000 | Mandel et al. | 493/23 |
| 6,027,107 | A | * | 2/2000 | Natsume et al. | 270/37 |
| 6,042,529 | A | * | 3/2000 | Hubler et al. | 493/434 |
| 6,164,043 | A | | 12/2000 | Miller et al. | |
| 6,517,655 | B1 | * | 2/2003 | Spencer et al. | 156/227 |
| 6,592,506 | B1 | * | 7/2003 | Lyga | 493/424 |

* cited by examiner

*Primary Examiner*—Stephen F. Gerrity
*Assistant Examiner*—Gloria R Weeks
(74) *Attorney, Agent, or Firm*—Angelo N. Chaclas; Alberta A. Vitale; George M. Macdonald

(57) ABSTRACT

The present invention is directed generally to a folder apparatus for sheets, and more particularly a folder with a fold path transverse to a feed path. In an embodiment, the folder comprises a channel for receiving a sheet, feed rollers for feeding the sheet along the feed path and through the channel, the feed rollers are axially aligned with the feed path, guide rollers positioned transverse to the feed path for feeding the sheet along a fold path to pinch rollers which pinch the sheet to form folds. The paper path does not reverse and the folding action is smooth so that noise and vibration are reduced. Also, the folder has a smaller footprint than other folders.

20 Claims, 7 Drawing Sheets

FOLDER APPARATUS WITH TRANSVERSE LOADING

FIELD OF THE INVENTION

This invention relates generally to a folder apparatus for folding sheet material, and more particularly concerns a sheet folder with a fold path transverse to a feed path.

BACKGROUND OF THE INVENTION

In the field of sheet material handling, folders are well known. Oftentimes, it is desirable to place one or more folds in a sheet or a plurality of sheets. Typically, the sheets may be made of paper, plastic, fabric or some other material. Folders have been developed to automate the folding process and thus obtain operational efficiencies over manual methods which tend to be labor intensive, costly and slow. There are various methods of generating folds in paper. These include buckle folding, knife folding, pinch folding and plow folding. In the mail preparation field, buckle chute folders and knife folders are well known.

Typically, a buckle chute folder comprises two or more fold rollers operating in cooperation with one or more buckle chutes and deflectors to place a sequence of folds in one or more sheets. A conventional buckle chute also includes a stop which is adjustably positioned within the chute for folding the sheets at a particular dimension or distance from the leading edge of the sheet. In operation, a first pair of rollers feeds a stack of sheets (or a single sheet) into the first buckle chute. When the leading edge of the stack hits the stop in the chute, forward progress of the stack ceases. However, the first pair of rollers continues to feed the stack causing a buckle to form in a predetermined location along the length of the stack near the entrance to the buckle chute. As the buckle grows, it enters the nip between another pair of rollers which are positioned adjacent the predetermined location. These rollers fold the stack along the buckle and feed the stack out of the buckle chute. This process is then repeated in subsequent downstream buckle chutes to produce more than one fold in the stack. Thus the feed path can have a long footprint.

Typical buckle chute folders 1, as shown in FIG. 1*a*, function by driving a sheet S along an input feed path F with drive rollers 3, 5 through a fold chamber 7 against a stop 9, and allowing a controlled buckle to form within an appropriately designed set of baffles. This buckle is drawn into a nip by a pair of fold rollers 3, 6. These rollers usually contact the sheet along most of its width and have a high normal force to insure a tight fold. Typically, knife folders 1*a*, as shown in FIG. 1*b*, work by registering one or more sheets S adjacent a pair of fold rollers 2, 4 by contacting an edge of the sheet S against a stop 9 and deflecting the sheet S into a fold nip using a moving knife edge bar 8 which is moved in the direction A as shown in FIG. 1*b*.

Another type of folder is a plow folder. Plow folders use long curved form guides to gradually fold a form as the form is fed widthwise along the guide. The fold is completed by feeding the form through a set of rollers. Plow folders are typically quite long as compared to the more compact design of the buckle chute or knife folders. Typical plow folders which are typically used in web folding apparatus and have a longer footprint than buckle chute or knife folders.

Folders are typically used in conjunction with mail processing systems which automatically insert folded sheets into envelopes. Common types of sheet folds are C-folds, Z-folds shown in FIGS. 1*c* and 1*d*, respectively. With the C-fold, sheets are folded twice as shown in FIG. 1*c*. With the Z-fold, sheets are folded twice in a Z configuration as shown in FIG. 1*d*. A Z-fold is commonly used when an address is desired to be indicated through the window of a window envelope (not shown).

Prior paper folding apparatus operate using complicated systems of rollers, paper stops and multiple paper path direction reversals to create each sheet fold separately. Typically the above described folders also rely on rapidly forcing the sheet through pinch rollers to create folds. These complex apparatus require greater manufacturing assembly and maintenance costs. Also, they result in high noise and vibration, and limited speed at which sheets can be folded and processed due to the serial nature of creating the folds. These systems also have an abundance of moving and stationary parts.

Thus there is a need for a folder which substantially overcomes the disadvantages and drawbacks associated with the prior art folders. Particularly, there is a need for folder to provide less noise, compact design and the ability to create folds substantially simultaneously. There is also a need for a folder with reduced manufacturing assembly and maintenance costs.

SUMMARY OF THE INVENTION

This invention overcomes the disadvantages of prior art folders by providing a folder which has a fold path transverse to a feed path. The folder overcomes disadvantages of other folders by creating multiple folds substantially simultaneously. Additional advantages include reduced noise and vibration and a smaller footprint.

This invention relates generally to a folder apparatus for folding sheet material, and more particularly concerns a folder with a fold path transverse to a feed path. In an embodiment of the present invention, the folder comprises a channel or sheet guide for receiving and/or guiding a sheet, feed rollers for feeding the sheet along the feed path and through the channel, the feed rollers are axially aligned with the feed path, guide rollers positioned transverse to the feed path for feeding the sheet along a fold path to pinch rollers which pinch the sheet to form folds. The paper path does not reverse and the folding action is smooth so that noise and vibration are reduced. Also, the folder has a smaller footprint than prior art plow folders.

An advantage of the present invention is that it provides folder that has a smaller footprint than prior art plow folders. Another additional advantage of the present invention is that the folder creates less noise and vibration than buckle chute or knife folders. Another advantage is that multiple folds can be created substantially simultaneously. Other advantages of the invention will in part be obvious and will in part be apparent from the specification. The aforementioned advantages are illustrative of the advantages of the various embodiments of the present invention.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1A:
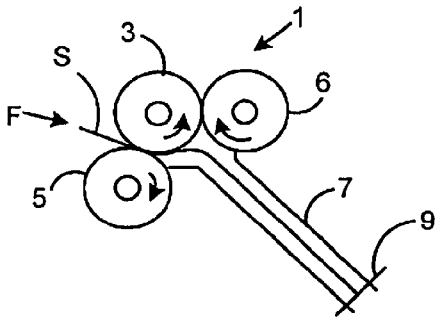
FIG.1a ( PRIOR ART )
FIG. 1*a* is a simplified side view of a typical prior art buckle chute folder.
Figure 1B:
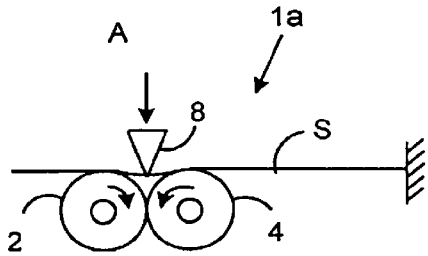
FIG.1b ( PRIOR ART )
FIG. 1*b* is a simplified side view of a typical prior art knife folder.
Figure 1C:
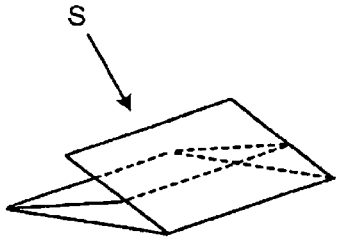
FIG. 1*c* is an isometric view of a C-folded sheet.
Figure 1D:
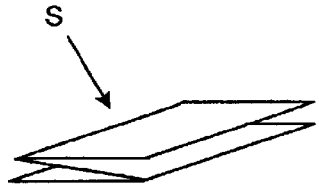
FIG. 1*d* is an isometric view of a Z-folded sheet.

In describing the present invention, reference will be made herein to FIGS. 1–10 of the drawings in which like numerals refer to like features of the invention. Features of the invention are not necessarily shown to scale in the drawings. All references cited in this specification, are incorporated by reference herein where appropriate for appropriate teachings of additional or alternative details, features, and/or technical background.

Figure 2:
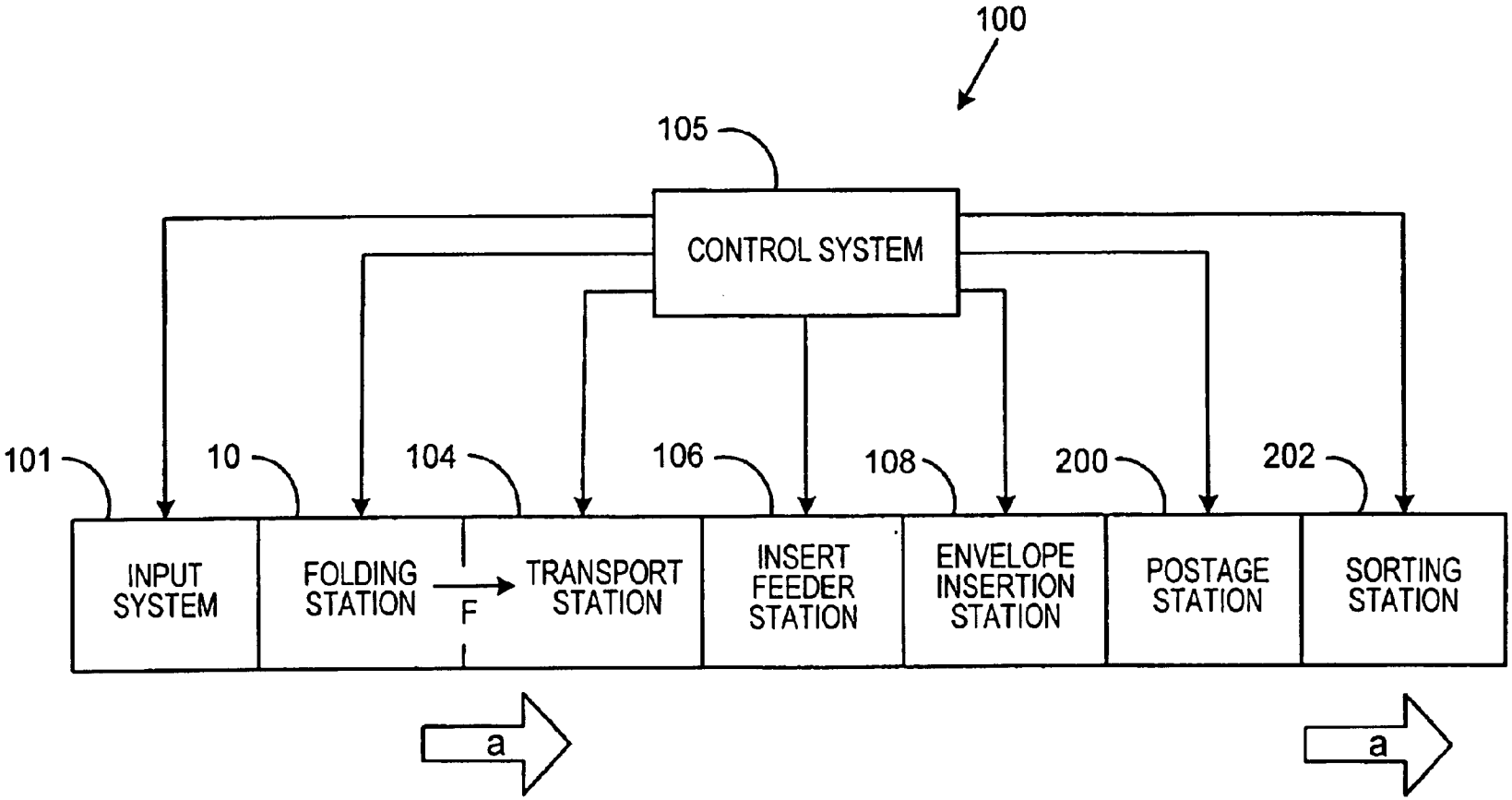
FIG. 2 is a block diagram schematic of a document inserting system in which the present invention folder is incorporated.

FIG. 2 is a schematic of a typical document inserting system, generally designated 100, which implements the present invention input system 101. In the following description, numerous document handling stations implemented in inserter system 100 are set forth to provide a thorough understanding of the operating environment of the folder 10 of the present invention. However it will become apparent to one skilled in the art that the present invention may be practiced without the specific details in regards to each of these document-handling stations.

As will be described in greater detail below, system 100 preferably includes an input system 101 that feeds sheets to an accumulating station that accumulates the sheets into collation packets. Preferably, only a single sheet of a collation is coded (the control document), which coded information enables the control system 105 of inserter system 100 to control the processing of documents in the various stations of the mass mailing inserter system. The code can comprise a bar code, UPC code or the like.

Generally, input system 101 feeds sheets in a feed path, as indicated by arrow "a," along what is commonly termed the main deck of inserter system 100. After sheets are accumulated into collations by input system 100, the collations are folded in folding station 10 and the folded collations are then conveyed to a transport station 104, preferably operative to perform buffering operations for maintaining a proper timing scheme for the processing of documents in inserting system 100.

Each sheet collation is fed from transport station 104 to insert feeder station 106. It is to be appreciated that a typical inserter system 100 includes a plurality of feeder stations, but for clarity of illustration only a single insert feeder 106 is shown. Insert feeder station 106 is operational to convey an insert (e.g., an advertisement) from a supply tray to the main deck of inserter system 100 so as to be nested with the aforesaid sheet collation being conveyed along the main deck. The sheet collation, along with the nested insert(s) are next conveyed into an envelope insertion station 108 that is operative to insert the collation into an envelope. The envelope is then preferably conveyed to postage station 200 that applies appropriate postage thereto. Finally, the envelope is preferably conveyed to sorting station 202 that sorts the envelopes in accordance with postal discount requirements.

As previously mentioned, inserter system 100 includes a control system 105 coupled to each modular component of inserter system 100, which control system 105 controls and harmonizes operation of the various modular components implemented in inserter system 100. Preferably, control system 105 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely transport station 104, insert feeder station 106, envelope insertion station 108, postage station 200 and sorting station 202) form no part of the present invention folding station 10, further discussion of each of these stations is also not described in detail in order not to obscure the present invention. Moreover, it is to be appreciated that the depicted embodiment of inserter system 100 implementing the present invention folding station 10 is only to be understood as an example configuration of such an inserter system 100. It is of course to be understood that such an inserter system may have many other configurations in accordance with a specific user's needs.

With respect to the control system, in general the disclosed inserter including the folding device may be readily operated and controlled in a conventional manner with conventional control systems. It is well known in general, and preferable, to program and execute such control functions and logic with conventional software instructions for conventional microprocessors. Such software may vary depending on the particular function and the particular software system and the particular microprocessor or microcomputer system being utilized, but will be available to or readily programmable by those skilled in the applicable arts without from either verbal functional descriptions, such as those provided herein, or prior knowledge of those functions which are conventional, together with general knowledge in the software and computer arts. Controls may alternatively be provided utilizing various other known or suitable hard-wired logic or switching systems.

FIGS. 3*a–d*, 6*a–b* and 7*a–b* are simplified illustrations of a front view of embodiments of the folder 10 in accordance with the present invention. The folder 10 can be used to create various fold configurations to a substrate such as, for example, a sheet S of paper. The various configurations could include those illustrated in FIGS. 1*c*, 1*d* and 1*e*, which represent a C-fold, a Z-fold and a half-fold, respectively. Other folds could also be accommodated through the use of variously configured feed paths as could be determined by one of ordinary skill in the art.

Returning to FIG. 3*a*, a simplified illustration of a front view of a folder 10 for producing a C-fold in accordance with an embodiment of the present invention. A channel 12 comprises first side 12*a* and second side 12*b* for defining feed path $F_{FE}$. Other configurations of paper guide methods can be determined by one of ordinary skill. At least one pair of input feed rollers 14, 16 is positioned at a first end 12*c* or inlet to the feed path $F_{FE}$ defined by the channel 12. One of the input feed rollers could be driven and the other input feed roller could be an idler roller. The input feed rollers 14, 16 together define a nip 18. Other configurations of input feed rollers, guide roller, channel rollers or other transport mechanism can be determined by one of ordinary skill in the art.

Figure 3A:
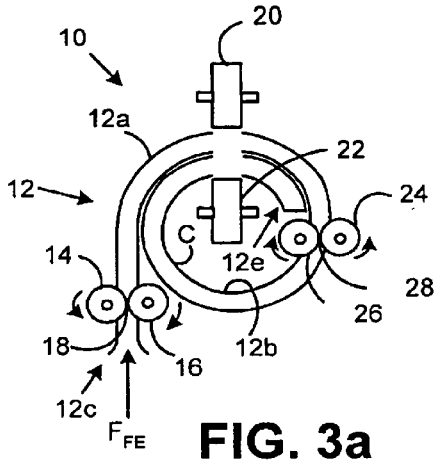
FIG. 3*a* is a simplified illustration of a front view of a folder for producing a C-fold in accordance with an embodiment of the present invention with feed rollers engaged.
Figure 3B:
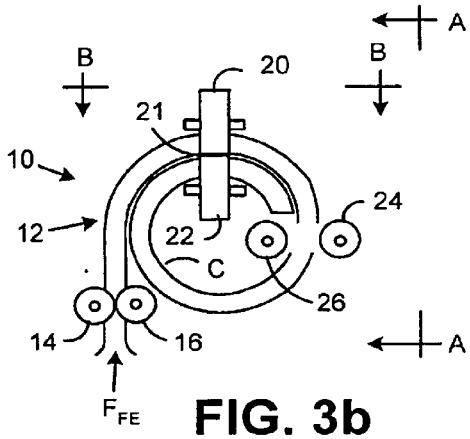
FIG. 3*b* is a simplified illustration of the front view of the folder of FIG. 3*a* with the feed rollers disengaged.

In the embodiment of FIG. 3*a* (and the other embodiments disclosed) the input feed rollers 14, 16 remain in the engaged position. It should be noted however that while input feed rollers 14, 16 are engaged in this embodiment of the invention, that they are not required to remain engaged in this and other embodiments of the present invention. The engagement or disengagement of the input feed rollers 14, 16 could be determined by one of ordinary skill in the art. At least one pair of guide rollers 20, 22 (first guide roller and second is positioned along the feed path $F_{FE}$ on an axis transverse to the feed path $F_{FE}$ and axially aligned with a fold path $F_{FO}$). The guide rollers are repositionable between a first and a second position (disengaged and engaged, respectively). FIG. 3*a* illustrates the guide rollers in the first position or disengaged. When the guide rollers 20, 22 are disengaged, the sheet S is being fed along feed path $F_{FE}$. Similarly, when the feed rollers 24, 26 are engaged, the sheet S is being fed along feed path $F_{FE}$. FIG. 3*b* illustrates the guide rollers in the second position or engaged. When the guide rollers 20, 22 are engaged, the sheet S is being fed along fold path $F_{FO}$. Similarly, when the feed rollers are disengaged, the sheet S is being fed along fold path $F_{FO}$. The folder 10 shown in FIG. 3*a* further comprises channel feed rollers 24, 26 engaged and forming a nip 28. In FIG. 3*b*, the channel feed rollers 24, 26 are shown in the second or disengaged position.

Figure 3C:
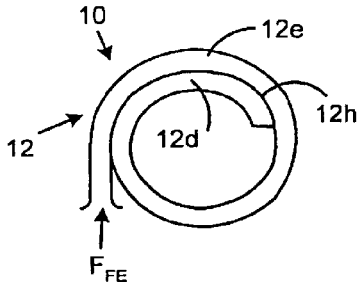
FIG. 3*c* is a simplified front view and alternate embodiment of the feed channel of the folder of the present invention illustrating a common wall shared by two portions of the feed channel.
Figure 3D:
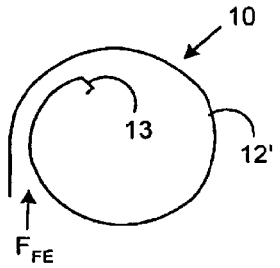
FIG. 3*d* is a simplified front view and alternate embodiment of the folder with a guide wall and stop.

FIG. 3*c* is a simplified front view and alternate embodiment of the feed channel 12 of the folder of the present invention illustrating a common wall 12*h* shared by an inner portion 12*d* and outer portion 12*e* of channel 12. The feed path $F_{FE}$ configuration of FIGS. 3*a–c* is configured for aligning a sheet for subsequent folding into a C-fold configuration such as the configuration shown in FIG. 1*c*. FIG. 3*d* is a simplified front view and alternate embodiment of the folder 10 with a guide wall 12' and stop 13. The guide wall performs a similar function to the channel 12 illustrated in other embodiments of the folder 10 of the present invention.

Figure 10:
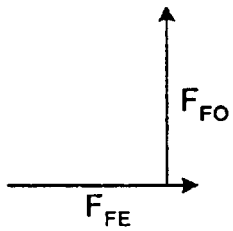
FIG. 10 is a simplified illustration of the feed path $F_{FE}$ of the folder of the present invention and the transverse fold path $F_{FO}$.

Returning to FIGS. 3*a* and 3*b*, one of ordinary skill in the art would realize that the channel 12 has an outer circumference of slightly more than two-thirds of the length of the long edge of sheet S to be folded to form the overlap of a C-fold. For example, two thirds of the long edge of a standard 8½ by 11 inch sheet S is slightly less than 7.5 inches and the resulting diameter is approximately 2.39 inches). In operation the folder 10 accepts sheet S which is typically loaded narrow or leading edge first (for example, if the sheet is an 8.5 inch by 11 inch paper, the 8.5" edge is the leading edge entering the feed path through the nip of input feed rollers 14, 16 from a tangential feed into the cylinder using transverse or channel feed rollers 24, 26 shown in FIG. 3*a*. As the sheet S is fed into the channel 12, the first third of the sheet S curls under the last third of the sheet S. Axial guide rollers 20, 22 engage the sheet in nip 21 close to the center of where the sheet S overlaps and the transverse feed rollers 24, 26 disengage as shown in FIG. 3*b*. The axial guide rollers 20, 22 then guide the pre-curled, overlapped sheet S through the plow folder portion to the slit end to form the creases of a C-fold from one side of the paper to the other. The sheet S emerges along fold path $F_{FO}$ short edge of the C-folded sheet first with creases along the long edge. FIG. 10 is a simplified illustration of the feed path $F_{FE}$ of the folder of the present invention and the transverse fold path $F_{FO}$. The folder 10 is not meant to be limited to the particular orientation of the transverse feed path $F_{FE}$ and fold path $F_{FO}$ illustrated in FIG. 10 which is shown for exemplary purposes.

Figure 4:
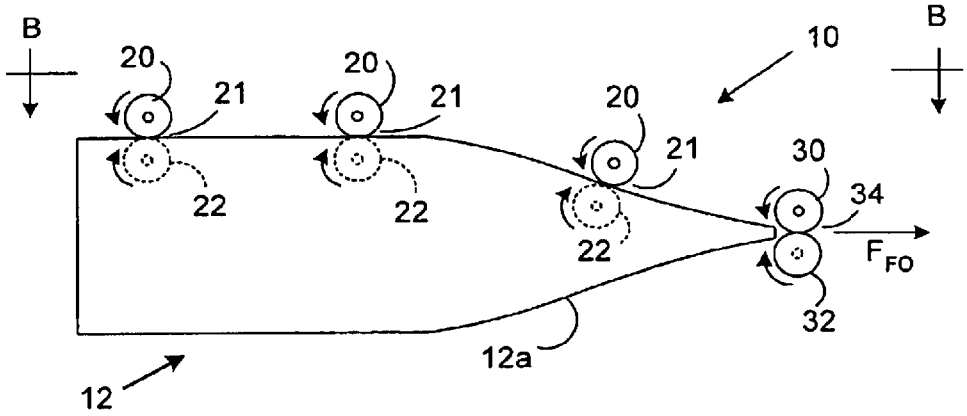
FIG. 4 is a simplified side view of the folder embodiments of FIG. 3*b* along line A—A of FIG. 3*b;*

FIG. 4 is a side view of the folder 10 the embodiment of FIG. 3*b* along line A—A of FIG. 3*b*. For simplicity, the input feed rollers 14, 16 and channel feed rollers 24, 26 are not shown in FIG. 4. In this view, the preferred three sets of guide rollers 20, 22 are shown in the engaged position. However, the folder 10 of the present invention is not meant to be limited to a particular number of guide rollers or other rollers. The number and placement of guide rollers 20, 22 can be determined by one of ordinary skill in the art considering factors such as the shape of the feed and fold paths. FIG. 4 illustrates the guide rollers in the second position or engaged. When the guide rollers 20, 22 are engaged, the sheet S is being fed along fold path $F_{FO}$. The folder 10 further comprises pinch rollers 30, 32 defining a nip 34. A sheet S, is fed along fold path $F_{FO}$ and through the nip 34 of pinch rollers 30, 32 and output from the nip 34 as a folded sheet. The cross-section of the plow folder smoothly transitions from the circular shape of the input to channel 12 represented in FIG. 3*a* to a flattened slit at pinch rollers 30, 32. Alternately, the cross-section of the plow folder smoothly transitions from a substantially racetrack (rounded ends or corners with flat middle section) shape of the input to channel 12 represented in FIG. 6*a* to a flattened slit at pinch rollers 30, 32.

Figure 5:
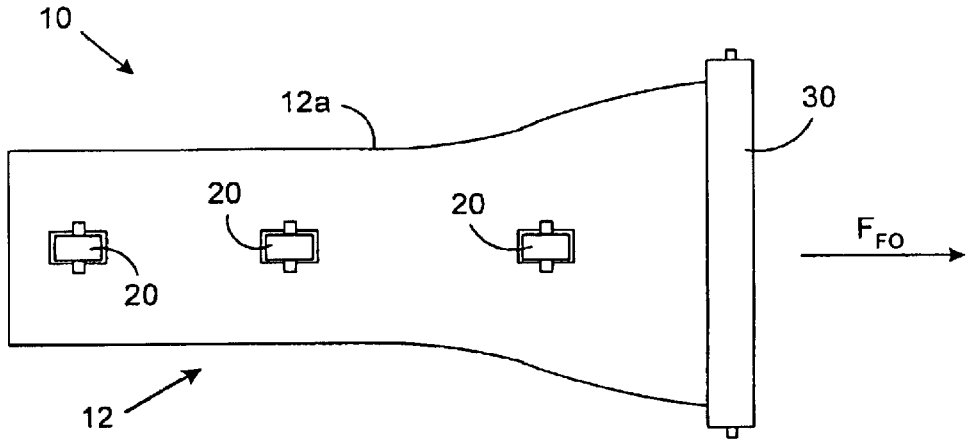
FIG. 5 is a simplified top view of the folder embodiments of FIGS. 3*b* and 6*a* along line B—B of FIGS. 3*b*, 4 and 6*a;*
Figure 6A:
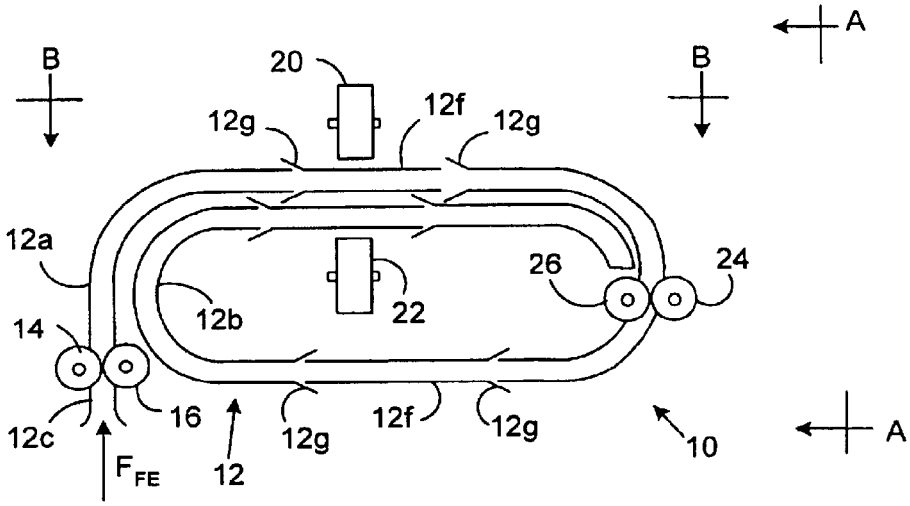
FIG. 6*a* is a simplified illustration of a front view of an alternate embodiment of the folder for producing a C-fold in accordance with an embodiment of the present invention with feed rollers engaged and guide rollers disengaged.

FIG. 5 is a top view of the folder embodiments of FIGS. 3*b* and 6*a* along line B—B of FIGS. 3*b*, 4 and 6*a* (FIG. 6*a* is described below). For simplicity, the input feed rollers 14, 16 and channel feed rollers 24, 26 are not shown in FIG. 5. As described above for FIG. 4, the preferred number of guide rollers is three sets and therefore, three first guide rollers 20 are shown in the top view of FIG. 5. FIG. 5 also illustrates the top view of the first side 12*a* of channel 12 and also the first pinch roller 30. Note that fold path $F_{FO}$ is axially aligned with guide rollers 20. FIG. 5 also illustrates the holes in the sides of channel 12 through which the rollers 20, 22 are accepted to contact the sheet S in channel 12. As described previously, the cross-section of the plow folder 10 smoothly transitions from the spiral (FIG. 3*a*) or racetrack (FIG. 6*a*) configuration of the channel 12 to a flattened slit at pinch rollers 30, 32. The width of the exit slit is greater than approximately one-third of the long or side edge of the sheet S.

FIG. 6*a* is a simplified illustration of a front view of an alternate embodiment of the folder for producing a C-fold in accordance with an embodiment of the present invention with feed rollers engaged. FIG. 6*a* illustrates the guide rollers in the first position or disengaged. When the guide rollers 20, 22 are disengaged, the sheet S is being fed along feed path $F_{FE}$. Similarly, when the feed rollers 24, 26 are engaged, the sheet S is being fed along feed path $F_{FE}$.

Figure 6B:
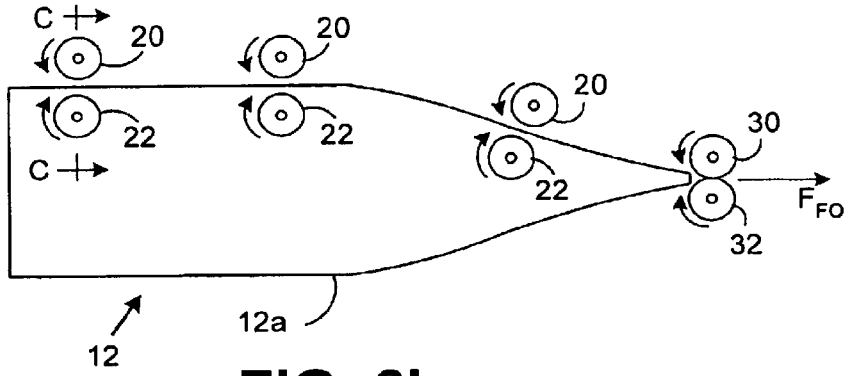
FIG. 6*b* is a simplified side view of the folder embodiment of FIG. 6*a* along line A—A of FIG. 6*a;*

The embodiment of FIG. 6*a* is similar to the embodiment of FIG. 3*a* in that it can be used to create a C-fold in a sheet. One difference is that the embodiment of FIG. 6*a* is configured to accept longer sheets. One shape that the embodiment of FIG. 6*a* can have is substantially racetrack or rounded rectangular shape (circular ends with a flat center portion). The channel 12 of folder 10 illustrated in FIG. 6*a* has a center portion 12*f* which can vary in length dependent upon the length of the sheet to be folded. The center portions 12*f* of channel 12 in FIG. 6*a* are configured with rounded edges facing the feed path $F_{FE}$ so as to provide a feed path in which the likelihood of jamming an edge of sheet S is minimized. To accommodate different sheet S sizes the channel could be constructed as two halves with a variable length flat center portion 12*f* (racetrack shape). The farther the halves are moved apart, the longer the sheet S that the channel could envelope. FIG. 6*b* is a simplified side view of the folder embodiments of FIG. 6*a* along line A—A of FIG. 6*a*.

Figure 6C:
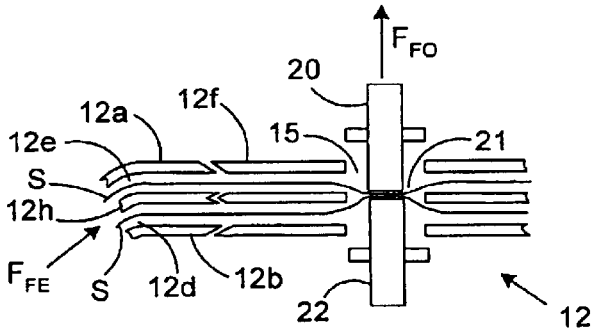
FIG. 6*c* is a simplified illustration of the cross-sectional view of an embodiment of the folder of the present invention along line C—C of FIG. 6*b* also illustrating an alternate configuration of feed channel with a common wall shared by two portions of the feed channel.

FIG. 6*c* is a simplified illustration of the cross-sectional view of an embodiment the folder of the present invention along line C—C of FIG. 6*b* also illustrating an alternate configuration of feed channel with a common wall 12*h* shared by two portions of the feed channel, the outer portion 12*e* and the inner portion 12*d* as illustrated in the front view of FIG. 3*c*. The embodiment also shows a configuration of the connections of the middle portion 12*f* to the remainder of the channel 12 so as to provide a feed path in which the likelihood of jamming an edge of sheet S is minimized. As can be seen in the illustration of FIG. 6*c*, the channel 12 sides 12*a*, 12*b*, 12*h* defines openings 15 through which the guide rollers 20, 22 pass when guide rollers 20, 22 are engaged defining a nip 21. When the guide rollers 20, 22 are engaged, the sheet S is being fed along fold path $F_{FO}$. FIG. 6*c* also illustrates portions of sheet S which are positioned along feed path FFE and within inner and outer sections 12*f*, 12*e* of the channel 12. The sheet S is nipped by engaged guide rollers 20, 22. The engaged guide rollers 20, 22 move sheet S along the fold path $F_{FO}$.

Figure 7A:
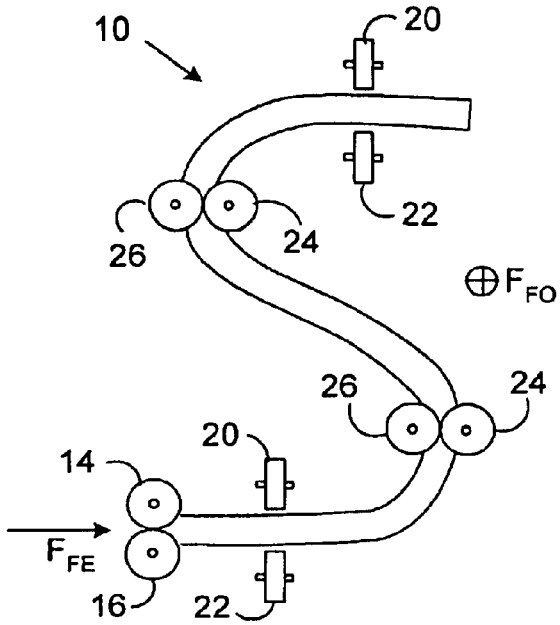
FIG. 7*a* is a simplified illustration of a front view of an alternate embodiment of the folder for creating a Z-fold in accordance with an embodiment of the present invention with feed rollers engaged.
Figure 7B:
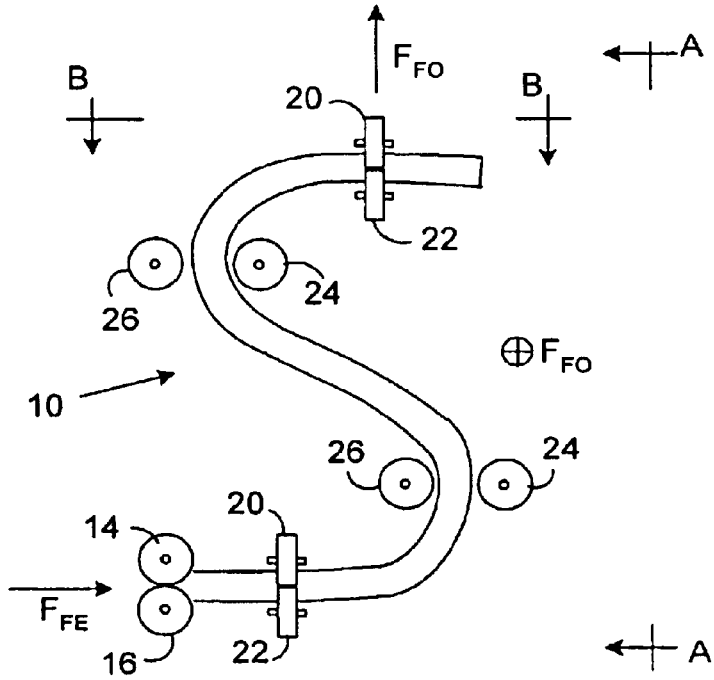
FIG. 7*b* is a simplified illustration of front view of the folder of FIG. 7*a* with the feed rollers disengaged.

FIG. 7*a* is a simplified illustration of a front view of an alternate embodiment of the folder for creating a Z-fold in accordance with an embodiment of the present invention with feed rollers engaged. When the guide rollers 20, 22 are disengaged, the sheet S is being fed along feed path $F_{FE}$. Similarly, when the feed rollers 24, 26 are engaged, the sheet S is being fed along feed path $F_{FE}$. FIG. 7*b* is a simplified illustration of front view of the folder of FIG. 7*a* with the feed rollers disengaged. When the guide rollers 20, 22 are disengaged, the sheet S is being fed along feed path $F_{FE}$. Similarly, when the feed rollers 24, 26 are engaged, the sheet S is being fed along feed path $F_{FE}$. In the configuration of FIGS. 7*a* and 7*b* the sheet S is fed into an S-shaped channel to produce a Z-folded sheet S. The guide rollers 20, 22 nip the sheet S and feed it along fold path $F_{FO}$. As is illustrated in FIGS. 7*a* and 7*b* the feed path $F_{FE}$ is transverse to the fold path $F_{FO}$. The transverse direction of fold path $F_{FO}$ is illustrated by the tail of arrow $F_{FO}$.

Figure 9:
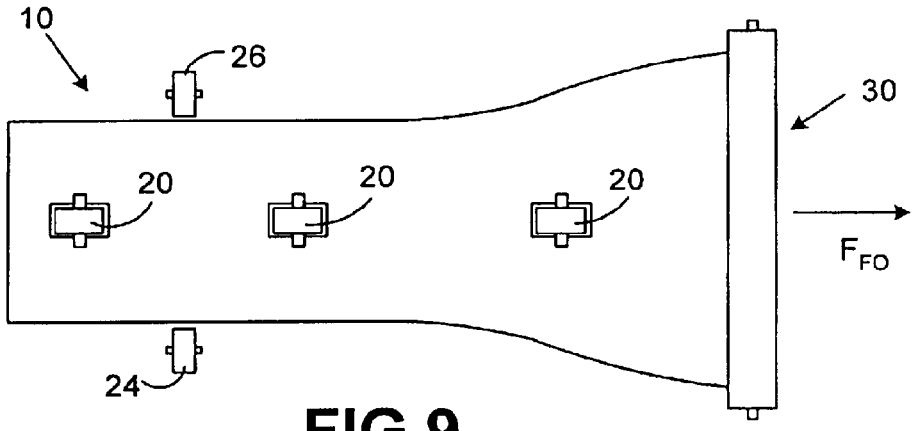
FIG. 9 is a simplified top view of the folder of FIG. 7*b* along line B—B of FIGS. 7*b* and 8.

FIG. 7*b* illustrates the guide rollers 20, 22 engaged and the feed rollers 24, 26 disengaged. When the guide rollers 20, 22 are engaged, the sheet S is being fed along fold path $F_{FO}$. Similarly, when the feed rollers are disengaged, the sheet S is being fed along fold path $F_{FO}$. FIG. 9 is a top view of the folder of FIG. 7*b* along line B—B of FIG. 7*b*.

Figure 8:
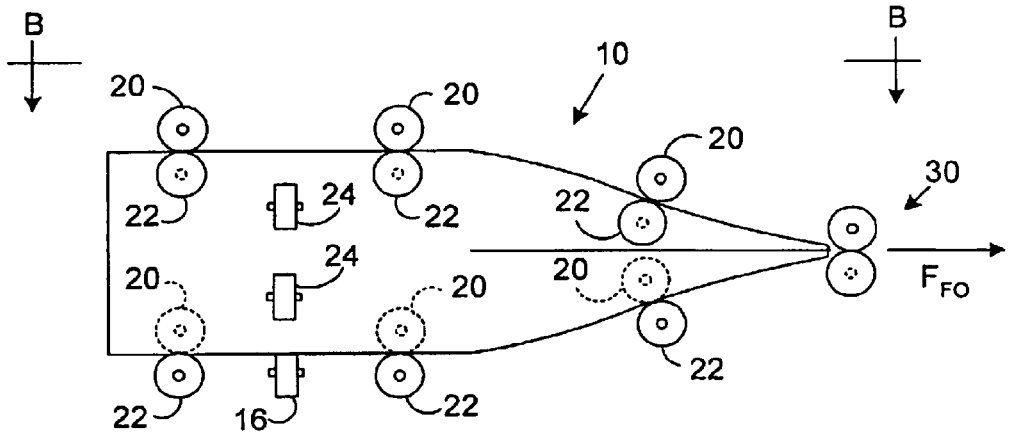
FIG. 8 is a simplified side view of the folder of FIG. 7*b* along line A—A of FIG. 7*b;*

FIG. 8 is a side view of the folder of FIG. 7*b* along line A—A of FIG. 7*b*. The side view of FIG. 8 illustrates guide rollers 20 for moving the sheet S (not shown in FIG. 8) along fold path $F_{FO}$ and through pinch rollers 30. The pinch rollers 30 create multiple creases substantially simultaneously in order to fold the sheet S in a Z-fold configuration.

For a Z-fold the initial S shape of the channel would be of tighter curvature in a smaller area than, for example the C-fold embodiment disclosed above. Factors to consider in designing the channel include increased tendency for the paper to buckle and geometry for placing feed and guide rollers. It should be noted that the exemplary transverse feed and fold paths illustrated in FIG. 10 and described above, corresponds to the transverse feed and fold paths of the embodiment of FIG. 9.

Figure 1E:
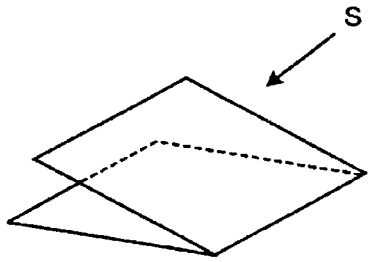
FIG. 1*e* is an isometric view of a half-folded sheet.

It should be noted that the present invention could also be configured to create other types of folds such as, for example, a C-fold (illustrated in FIG. 1*e*). The channel or guide for a C-fold could be similar in shape to the channel of FIGS. 3*a* and 3*b*; however, the channel would not overlap in the spiral configuration shown in FIGS. 3*a* and 3*b*. Rather, the channel could end at a third side positioned between sides 12*a* and 12*b* at point C noted in FIGS. 3*a* and 3*b*. One of ordinary skill in the art would be able to determine the channel or guide configuration as well as roller configurations for creating various folds.

It should also be noted that in designing the channel for the present invention, the contour of the chamber is important for proper feeding without wrinkling or skewing. Scratches or foreign objects in the channel can impair travel of sheet S through feed path $F_{FE}$ by providing an edge or object upon which the sheet S could jam. Such considerations can be taken into account by one of ordinary skill in the art when performing the invention. Scratches on the chute may significantly impair proper function. Keeping foreign objects out of the chute is imperative.

The present invention uses a chamber that is cylindrical at one end and flattened to a narrow slit on the other end to form a portion of a plow folder. The paper is loaded into the cylindrical end tangential to the cylinder and then guided through the plow folder. Since the paper is pre-curled and overlapped when loaded, it circumvents a majority of the extensive length of traditional plow folder to provide a more compact design. In addition, this design has fewer parts than pinch roller solutions resulting in lower manufacturing assembly and maintenance costs. The elimination of paper path reversals combined with smooth folding action significantly reduces noise and vibration and is more conducive to high speed folding applications.

The elimination of paper path reversals combined with smooth folding action significantly reduces noise and vibration and is more conducive to high speed folding applications. In addition, this design has fewer parts than pinch roller solutions resulting in lower manufacturing assembly and maintenance costs. The elimination of paper path reversals combined with smooth folding action significantly reduces noise and vibration and is more conducive to high speed folding applications.

The present invention provides a device to fold sheets. An advantage of the device is that noise and vibration are reduced. Another additional advantage of the present invention is that it has a smaller footprint. It further provides the ability to create folds substantially simultaneously. While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A folder apparatus for folding a sheet having a leading edge, a trailing edge and first and second side edges, the folder apparatus comprising:

a channel comprising first and second sides, the first and second sides forming a feed path for the folder apparatus, the channel having a first end and a second end, the first and second side defining an opening at the first end, and the first and second sides adjacent to a third side forming a stop at the second end of the channel;

a first and second input feed rollers forming a nip there between and axially aligned with the feed path, the first input feed roller positioned adjacent to and configured to pass through the first side of the channel and the second input feed roller positioned adjacent to and configured to pass through the second side of the channel;

at least one pair of guide rollers positioned on an axis transverse to the feed path and axially aligned with a fold path, the at least one pair of guide rollers comprising a first and second guide roller, each of the guide rollers repositionable between a first and second position and forming a nip there between in the second position, the first and second guide rollers positioned down stream of the first end of the channel, the first guide roller positioned adjacent to and configured to pass through the first side of the channel when the first guide roller is in the second position, the second guide roller positioned down stream of the first end of the channel, the second guide roller positioned adjacent to and configured to pass through the second side of the channel when the second guide roller is in the second position;

at least one pair of channel feed rollers axially aligned with the feed path comprising first and second channel feed rollers, each of the channel feed rollers repositionable between a first and second position and forming a nip there between in the second position; the first and second channel feed rollers positioned down stream of the at least one pair of guide rollers and on *an axis transverse to the feed path, the first channel feed roller positioned adjacent to and configured to pass through the first side of the channel when the first channel feed roller is in the second position, the second channel feed roller positioned adjacent to and configured to pass through the second side of the channel when the second channel feed roller is in the second position; and at least one pair of pinch rollers comprising first and second pinch rollers and forming a nip there between, the at least one pair of pinch rollers positioned on an axis transverse to the feed path and axially aligned with the fold path;

whereby the leading edge of the sheet enters the channel at the first end and is fed by the input feed rollers along the feed path and nipped by the at least one pair of channel feed rollers positioned in the second position, to the second end of the channel along the feed path until the leading edge of the sheet reaches the second end of the channel and when the leading edge of the sheet is positioned at the second end of the channel, the channel feed rollers return to the first position and the at least one pair of guide rollers moves to the second position and moves the sheet first side edge first along the fold path transverse to the feed path to the at least one pair of pinch rollers which fold the sheet as the sheet passes through the nip of the at least one pair of pinch rollers along the fold path.

2. The apparatus as claimed in claim 1 wherein the first and second sides of the channel comprise at least one guide wire.

3. The apparatus as claimed in claim 1 wherein the first and second sides of the channel comprise wire mesh.

4. The apparatus as claimed in claim 1 wherein the first and second sides of the channel comprise a metal sheet.

5. The apparatus as claimed in claim 1 wherein the feed path defined by the channel is a spiral shape.

6. The apparatus as claimed in claim 1 wherein the feed path defined by the channel is an S shape.

7. The apparatus as claimed in claim 1 wherein the feed path defined by the channel is a racetrack shape.

8. The apparatus as claimed in claim 7 wherein the racetrack feed path comprises at least two substantially parallel segments that are replaceable.

9. A folder apparatus for folding a sheet having a leading edge, a trailing edge and first and second side edges, the folder apparatus comprising:

a channel comprising first and second sides, the first and second sides forming a feed path for the folder apparatus, the channel having a first end and a second end, the first and second side defining an opening at the first end, and the first and second sides adjacent to a third side forming a stop at the second end of the channel;

a first and second input feed rollers forming a nip there between and axially aligned with the feed path, the first input feed roller positioned adjacent to and configured to pass through a first opening defined by the first side of the channel and the second input feed roller positioned adjacent to and configured to pass through a first opening defined by the second side of the channel;

at least one pair of guide rollers positioned on an axis transverse to the feed path and axially aligned with a fold path, the at least one pair of guide rollers comprising a first and second guide roller, each of the guide rollers repositionable between a first and second position and forming a nip there between in the second position, the first and second guide rollers positioned down stream of the first end of the channel, the first guide roller positioned adjacent to and configured to pass through a second opening defined by the first side of the channel when the first guide roller is in the second position, the second guide roller positioned down stream of the first end of the channel, the second guide roller positioned adjacent to and configured to pass through a second opening defined by the second side of the channel when the second guide roller is in the second position;

at least one pair of channel feed rollers axially aligned with the feed path comprising first and second channel feed rollers, each of the channel feed rollers repositionable between a first and second position and forming a nip there between in the second position; the first and second channel feed rollers positioned down stream of the at least one pair of guide rollers and on an axis transverse to the feed path, the first channel feed roller positioned adjacent to and configured to pass through a third opening defined by the first side of the channel when the first channel feed roller is in the second position, the second channel feed roller positioned adjacent to and configured to pass through a third opening defined by the second side of the channel when the second channel feed roller is in the second position; and at least one pair of pinch rollers comprising first and second pinch rollers and forming a nip there between, the at least one pair of pinch rollers positioned on an axis transverse to the feed path and axially aligned with the fold path;

whereby the leading edge of the sheet enters the channel at the first end and is fed by the input feed rollers along the feed path and nipped by the at least one pair of channel feed rollers positioned in the second position, to the second end of the channel along the feed path until the leading edge of the sheet reaches the second end of the channel and when the leading edge of the sheet is positioned at the second end of the channel, the channel feed rollers return to the first position and the at least one pair of guide rollers moves to the second position and moves the sheet first side edge first along the fold path transverse to the feed path to the at least one pair of pinch rollers which fold the sheet as the sheet passes through the nip of the at least one pair of pinch rollers along the fold path.

10. The apparatus as claimed in claim 9 wherein the first and second sides of the channel comprise at least one guide wire.

11. The apparatus as claimed in claim 9 wherein the first and second sides of the channel comprise wire mesh.

12. The apparatus as claimed in claim 9 wherein the first and second sides of the channel comprise a metal sheet.

13. The apparatus as claimed in claim 9 wherein the feed path defined by the channel is a spiral shape.

14. The apparatus as claimed in claim 9 wherein the feed path defined by the channel is an S shape.

15. The apparatus as claimed in claim 9 wherein the feed path defined by the channel is a racetrack shape.

16. The apparatus as claimed in claim 15 wherein the racetrack feed path comprises at least two substantially parallel segments that are variable in length.

17. A folder apparatus for folding a sheet, the folder apparatus comprising:

means for defining a feed path for the folder apparatus having a channel, means for moving the sheet into the channel along the feed path;

means for moving the sheet along a fold path transverse to the feed path; and means for forming one or more folds in the sheet as the sheet travels along at least a portion of the fold path;

whereby when the means for forming one or more folds in the sheet is forming more than one fold, the folds are formed substantially simultaneously.

18. The folder apparatus as claimed in claim 17 wherein the means for defining the feed path is a spiral shape.

19. The folder apparatus as claimed in claim 17 wherein the means for defining the feed path is an S shape.

20. The folder apparatus as claimed in claim 17 wherein the means for defining the feed path is a racetrack shape.

* * * * *